United States Patent [19]

Stinger

[11] 4,229,836

[45] Oct. 28, 1980

[54] FACE SHIELD/HELMET AIRFLOW NOISE REDUCER

[76] Inventor: William Stinger, 6906 Virginia Ave., St. Louis, Mo. 63111

[21] Appl. No.: 18,459

[22] Filed: Mar. 7, 1979

[51] Int. Cl.[3] ..... A42B 3/00; A61F 9/04; A42B 1/24

[52] U.S. Cl. ..... 2/422; 2/10; 2/424

[58] Field of Search ..... 2/10, 9, 6, 424, 423, 2/173, 205, 422

[56] References Cited

U.S. PATENT DOCUMENTS

| | | | |
|---|---|---|---|
| 3,162,862 | 12/1964 | Miller | 2/6 |
| 3,548,410 | 12/1970 | Parker | 2/424 |
| 3,806,951 | 4/1974 | Halteman | 2/6 |
| 3,825,952 | 7/1974 | Pershing | 2/422 |
| 4,017,906 | 4/1977 | Bochynsky et al. | 2/205 X |
| 4,070,712 | 1/1978 | Marwitz | 2/10 |

FOREIGN PATENT DOCUMENTS

| | | | |
|---|---|---|---|
| 2142221 | 1/1973 | France | 2/10 |

*Primary Examiner*—Peter P. Nerbun

[57] ABSTRACT

A device constructed of flexible, compressible material, like foam rubber, which is affixed between a crash helmet, as used by motorcycle, motorbike and similar vehicle riders, and a transparent face shield rigidly fixed thereto and contoured to cover substantially the entire face of the wearer. The device when affixed as described completely eliminates eye irritating and annoying noise produced by wind rushing between the crash helmet and the transparent face shield.

4 Claims, 3 Drawing Figures

FACE SHIELD/HELMET AIRFLOW NOISE REDUCER

BACKGROUND OF THE INVENTION

The present invention generally relates to a device which eliminates wind rushing noise between a crash helmet and face shield structures.

With the ever increasing popularity of relatively high speed motorcycles, conventional protective helmets, while satisfactory to a certain degree, do not satisfy the requirements of all users of such equipment. One type of helmet commonly used is a type which protects the face of the motorcycle operator by providing a partial cylindrical transparent face shield. The periphery of the face shield overlaps the helmet shell and is fixedly secured thereto by a plurality of fasteners such as rivets or any suitable type of releasable fastener such as a screw threaded fastener, snap fastener or the like which would enable the face shield to be removed or replaced in the event of damage thereto. The bottom edge of the face shield and the crash helmet surrounding the rider's upper neck are open so as to provide access to the interior of the helmet and face shield assembly to facilitate it being placed on the head of the wearer and removed therefrom.

With the most common types of crash helmets equipped with transparent face shields available today, a gap or space up to one-half (½) inch in width exists between the periphery of the face shield where it overlaps and is affixed to the helmet with fasteners, and the underlying front leading edge of the helmet itself. As the cyclist proceeds forward, wind rushing through this gap passes down over the face and ears as it exits out of the bottom of the helmet and affixed face shield surrounding the upper neck. This wind flow disturbance behind the face shield and surrounding helmet results in eye irritation and annoying noise which increases in intensity as the cyclist goes faster and faster. The present invention eliminates this eye irritating and noisy wind flow disturbance while still allowing a milder airflow to promote comfort and help prevent fogging of the face shield.

SUMMARY OF THE INVENTION

An object of the invention is to provide a flexible, compressible device that can be affixed between a crash helmet, as worn by motorcycle riders, and a transparent face shield that is fixedly attached thereto by releasable snap fasteners, such that the device eliminates eye irritating and noisy wind flow disturbance as described above.

Another and particularly important object is to provide for said device to be removable and replaceable as required, and thus easily transferable from one helmet to another. Because said device is removable and usable with other helmets, present methods used by motorcycle riders to reduce the wind flow disturbance that include the use of sticky, messy adhesive-backed tape are eliminated.

These and other objects and advantages will be apparent from the ensuing description and the appended drawings.

DETAILED DESCRIPTION

Figure 1:
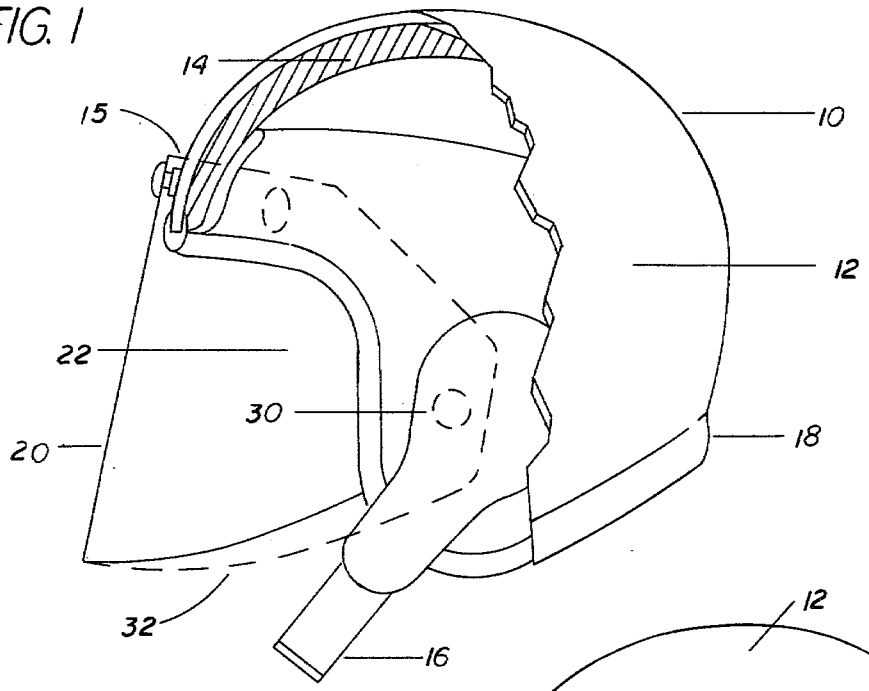
FIG. 1 is a side perspective view of a crash helmet and transparent face shield, with the face shield overlapping the helmet and fixedly secured thereto by suitable releasable fasteners.
Figure 2:
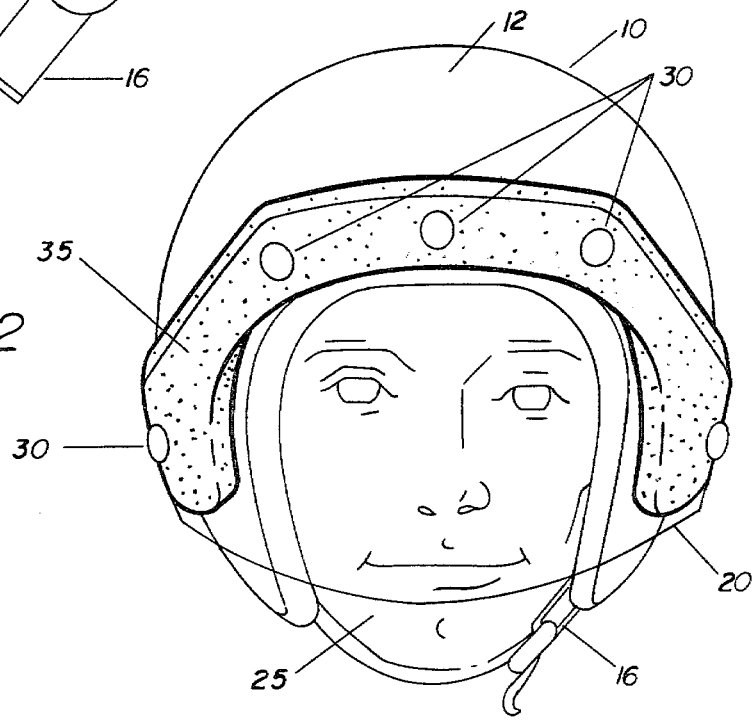
FIG. 2 is a front perspective view of the crash helmet and transparent face shield, with said device which is the subject of the invention shown in place between the periphery of the face shield and the underlying front leading edge of the helmet.
Figure 3:
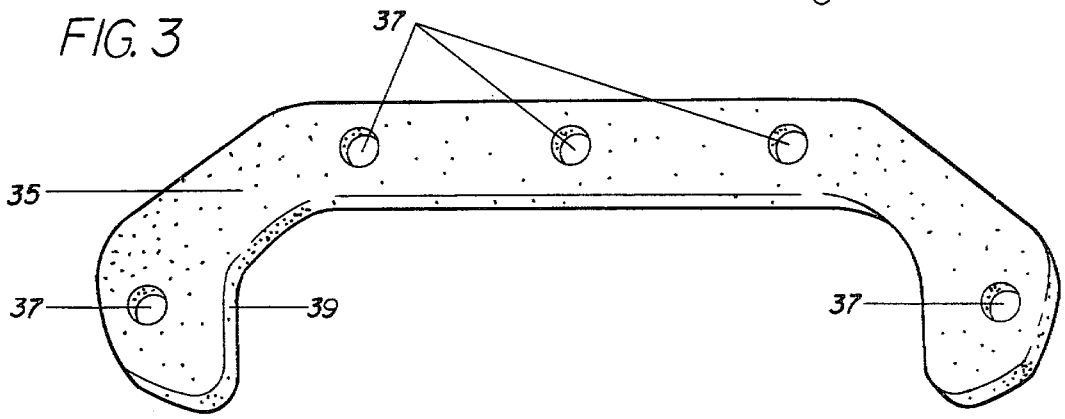
FIG. 3 is a front perspective view of the device itself which is the subject of this invention.

Referring now specifically to the drawing and its FIGS., the helmet is generally designated by the numeral 10 and the transparent face shield generally designated by the numeral 20, with these two components being fixedly attached to each other in such a manner that the assembled face shield and helmet may be placed on or removed from the head of the wearer in a well-known and conventional manner.

The helmet 10 includes a shell 12 of rigid construction shaped generally in a spherical or curved manner to conform and fit the head of wearer 25 such as the operator of a motorcycle. The shell 12 is provided with a cushioned liner 14 or the like which can be constructed in a manner to be replaceable for repair or to enable liners of various colors to be employed. Also provided on the helmet is the usual chin strap assembly designated by the numeral 16 which is provided with an adjustable buckle arrangement all of which are well known in the art, with the chin strap and buckle assembly meeting all safety specifications required by state law, racing association regulations and the like. The shell 12 may be of any suitable color, provided with flake metal coloring or the like, and may be constructed of any suitable lightweight and substantially rigid material having the requisite strength characteristics such as molded plastic material, glass reinforced resin material or any other material from which protective helmets of this nature are constructed.

The peripheral edge of the helmet shell 12 is provided with a binding tape or edging 18, with the forward portion of the helmet 10 being cut-away in a manner to define a face opening 22. The face shield 20 forms a protective shield for the face 25 of the wearer and generally is curved and contoured to form a continuation of the curvature of the shell 12 of the helmet 10, with the upper and side periphery of the face shield 20 overlying and conforming with the periphery of the opening 22 as illustrated in FIG. 1. The face shield is constructed of a transparent panel or shell 20 and the periphery thereof which overlaps the helmet shell 12 is fixedly secured thereto by a plurality of fasteners 30 such as rivets or any suitable type of releasable fastener such as a screwthreaded fastener, snap fastener or the like which would enable the face shield to be removed if desired or replaced in the event of damage thereto. The face shield 20 may be constructed of any suitable high impact transparent plastic material or the like and may be clear or provided with any suitable tint characteristics as may be desired. The bottom edge of the transparent face shield 20 is open as at 32 which provides access to the interior of the helmet and face shield assembly to facilitate it being placed on the head of the wearer and removed therefrom.

When the helmet 10 with transparent face shield 20 affixed is worn by a motorcycle rider traveling at higher speeds (50 miles per hour plus), wind flowing through the up to one-half (½) inch space or gap 15 between the face shield 20 and the leading edge of the helmet shell 12 causes a wind flow disturbance which irritates the motorcyclist's eyes and overall creates annoying noises as it passes over the rider's ears and face before exiting through the opening 32. When said device 35, constructed of flexible, compressible material, like foam rubber, is inserted between the face shield 20 and the leading front edge of helmet shell 12 and held in place by holes 37 being fitted around the fasteners or the like which affix the face shield 20 to the helmet shell 12, the space or gap 15 is eliminated by the thickness 39 (½ inch) of said device 35. Elimination of gap 15 eliminates wind flow disturbance 25 while still allowing a milder airflow through helmet and face shield opening 32 to promote comfort and help prevent fogging of the face shield.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A device constructed of flexible, compressible material, that can be affixed between a standard crash helmet, as worn by motorcycle riders, and a standard transparent face shield that is fixedly attached thereto by releasable fasteners, said device having holes formed therein through which the releasable fasteners extend thus enabling the device to be readily removable from said helmet and said face shield upon separation of said fasteners whereby said device stops wind flow between the top and sides of the face shield and where it attaches to the helmet, and so greatly reduces noise and irritating wind turbulence.

2. The device as defined in claim 1 is both attachable and detachable from the front edge of a standard crash helmet around the fasteners when a standard face shield is removed from the helmet by pulling away from the releasable fasteners.

3. The device as defined in claim 2 which is removable and replaceable in case said device is damaged, destroyed, becomes dirty or greasy through use, or has been lost.

4. Said device as defined in claims 1, 2 or 3 which is constructed of flexible, compressible material like foam rubber.

* * * * *